US006056629A

United States Patent [19]

Ohmori

[11] Patent Number: 6,056,629

[45] Date of Patent: May 2, 2000

[54] FREE FORM MACHINING TOOL

[75] Inventor: Hitoshi Ohmori, Wako, Japan

[73] Assignees: The Institute of Physical and Chemical Research (RIKEN), Wako; Ikegami Mold Engineering Co., Ltd., Kuki, both of Japan

[21] Appl. No.: 08/978,814

[22] Filed: Nov. 26, 1997

[30] Foreign Application Priority Data

Nov. 26, 1996 [JP] Japan ..... 8-315093

[51] Int. Cl.[7] ..... B24B 3/00

[52] U.S. Cl. ..... 451/211; 451/295

[58] Field of Search ..... 451/271, 211, 451/295

[56] References Cited

U.S. PATENT DOCUMENTS

| | | | |
|---|---|---|---|
| 1,945,240 | 1/1934 | Tupica | 255/71 |
| 2,025,260 | 12/1935 | Zublin | 255/71 |
| 2,336,336 | 12/1943 | Zublin | 255/71 |
| 2,732,671 | 1/1956 | McFadden | 51/170 |
| 4,096,917 | 6/1978 | Harris | 175/228 |
| 4,203,496 | 5/1980 | Bakwe, III et al. | 175/329 |

*Primary Examiner*—David A. Scherbel
*Assistant Examiner*—Dung Van Nguyen
*Attorney, Agent, or Firm*—Griffin, Butler, Whisenhunt & Szipl, LLP

[57] ABSTRACT

In a free form machining tool 10 for machining a surface to be machined while bringing the lower end into contact with the surface to be machined by a rotation around an axis z, the tool comprises a spherical tool 12 having a spherical surface machining section 13 on the lower portion, and a bearing 14 for supporting the spherical tool by an axis a of rotation which passes through the center ○ of the spherical surface and is different from the axis. The tool also includes rotating means 16 (for example, a turbine) for rotating the spherical tool around the axis of rotation. Thus, even if the spherical surface machining section comes into contact with the surface to be machined on the axis (radius: 0) of the tool, the spherical surface machining section is rotated around the axis a of rotation which is different from the axis z. Therefore, a peripheral speed of the axis is not zero (0). It is possible to efficiently work a freely curved surface with high accuracy and high quality by the use of a conventional three-axial NC machining apparatus.

7 Claims, 5 Drawing Sheets

Fig.1A
PriorArt
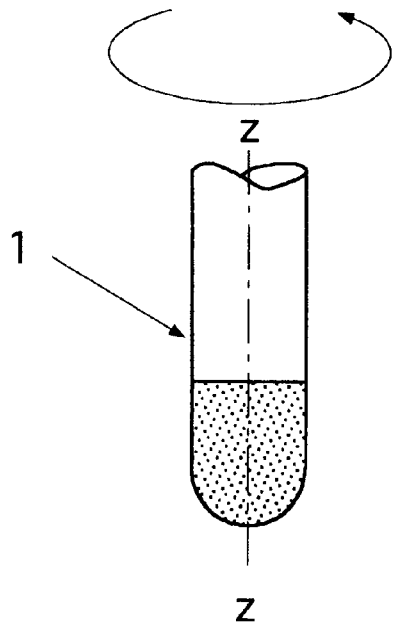
Fig.1B
PriorArt
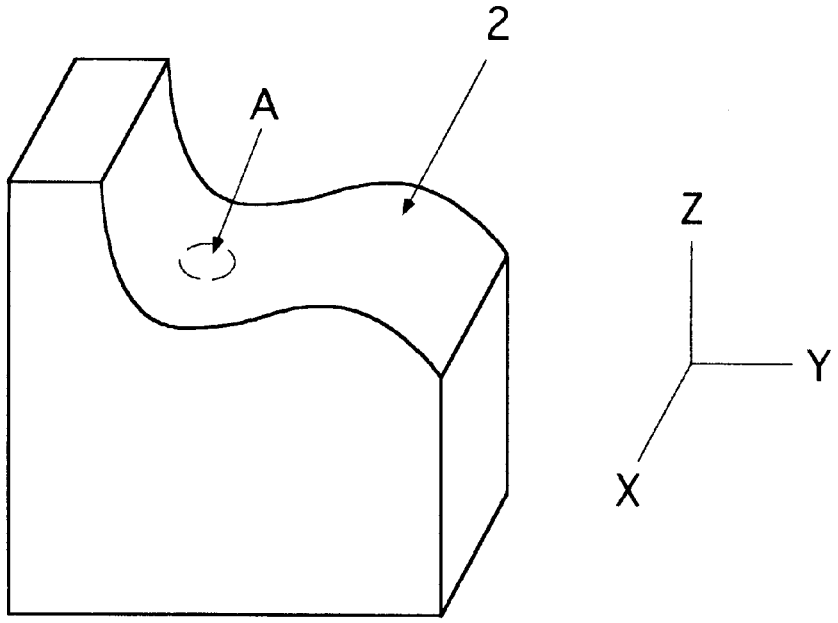

FREE FORM MACHINING TOOL

BACKGROUND ART

1. Fieid of the Invention

The present invention relates to a free form machining tool having a spherical surface machining section on a lower end for machining a freely curved surface.

2. Description of the Related Art

FIG. 1A shows a conventional free form machining tool. FIG. 1B typically shows a freely curved surface to be machined by this machining tool. A conventional free form machining tool 1 is, for example, a ball nose grinder or a ball end mill. The machining tool 1 has a spherical machining surface (such as a grinder or a cutting blade) on the lower end thereof (in this drawing). The machining tool 1 is rotated around an axis z. A freely curved surface 2 is, for example, a pressing mold, an aspherical lens or the like. The free form machining tool 1 is rotated around the axis z at high speed, while the lower end is moved along the freely curved surface 2 so as to work (grind or cut) the freely curved surface 2. A repetition of such a work allows the freely curved surface such as a mold or aspherical lens to be freely machined by the machining tool 1.

The aforementioned free form machining tool 1 is rotated around the axis z. Thus, the surface to be machined has a peripheral speed of zero (0) on the axis (radius: 0). Therefore, even if a triaxial (X-Y-Z) NC machining apparatus is used, the position of the axis (radius: 0) is a dead spot. Disadvantageously, this position cannot be excellently machined. Thus, the free form machining tool 1 has been heretofore mounted to a multi-axial NC machining apparatus having four or five axes. For machining a portion (for example, a portion A) where the freely curved surface is perpendicular to the z-axis, a program is made so that the axis z of the machining tool 1 may be appropriately angled with respect to the z-axis. However, such programming is complicated and difficult. Furthermore, the multi-axial NC machining apparatus having four or more axes is expensive. Accordingly, there is a problem that this has little general-purpose properties.

SUMMARY OF THE INVENTION

The present invention is proposed in order to solve the above problems. That is, it is an object of the present invention to provide a free form machining tool which does not have a peripheral speed of zero (0) on its axis and thus can efficiently work a freely curved surface with high accuracy and high quality by the use of a conventional triaxial NC machining apparatus.

According to the present invention, there is provided a free form machining tool for machining a surface to be machined while bringing the lower end into contact with the surface to be machined by a rotation around an axis, the tool which comprises a spherical tool having a spherical surface machining section at least on the lower portion; and a bearing for supporting the spherical tool by an axis of rotation which passes through the center of the spherical surface and is different from the axis.

According to a preferred embodiment of the present invention, the spherical tool comprises a cylindrical straight section supported by the bearing and having an axis which is the axis of rotation of the bearing; and a spherical surface machining section disposed on the lower portion of the straight section. Furthermore, the spherical surface machining section is made of a grinder or a cutting blade. Preferably, the grinder includes a metal as its bonding material.

According to a construction of the present invention, the free form machining tool comprises the spherical tool having the spherical surface machining section on the lower portion and the bearing for supporting the spherical tool by the axis of rotation which is different from the axis. Thus, even if the spherical surface machining section comes into contact with the surface to be machined on the axis (radius: 0) of the tool, the spherical surface machining section is rotated around an axis a of rotation which is different from an axis z. Therefore, the peripheral speed of the axis is not zero (0). It is possible to efficiently work the freely curved surface with high accuracy and high quality by the use of the conventional triaxial NC machining apparatus.

Furthermore, the free form machining tool comprises rotating means for rotating the spherical tool around the axis of rotation. Preferably, the rotating means of the spherical tool comprises any one of a turbine, a motor, a gear train and external power transmitting means or a combination of these.

According to this construction, the rotating means such as the turbine, the motor, the gear train and the external power transmitting means allows the spherical tool to be positively rotated around the axis of rotation. It is possible to properly maintain a machining speed by the spherical surface machining section.

The free form machining tool further comprises correcting means for correcting the spherical surface machining section of the spherical tool. Preferably, the correcting means comprises a grinder, an electrolysis, discharging means or composite means of these. Preferably, the correcting means is operated at the same time that a material to be machined is machined.

According to this construction, the correcting means such as the grinder, the electrolysis, the discharging means can correct the spherical surface machining section, preferably, at the same time that the material to be machined is machined. It is possible to continue the high-accuracy/high-quality machining for a long time.

Other objects and advantageous features of the present invention will be apparent from the following description with reference to the accompanying drawings.

BRIEF DESCRIPTION OF THE DRAWINGS

FIG. 1A shows a conventional free form machining tool.

FIG. 1B typically shows a conventional freely curved surface.

DESCRIPTION OF THE PREFERRED EMBODIMENTS

Figure 2:
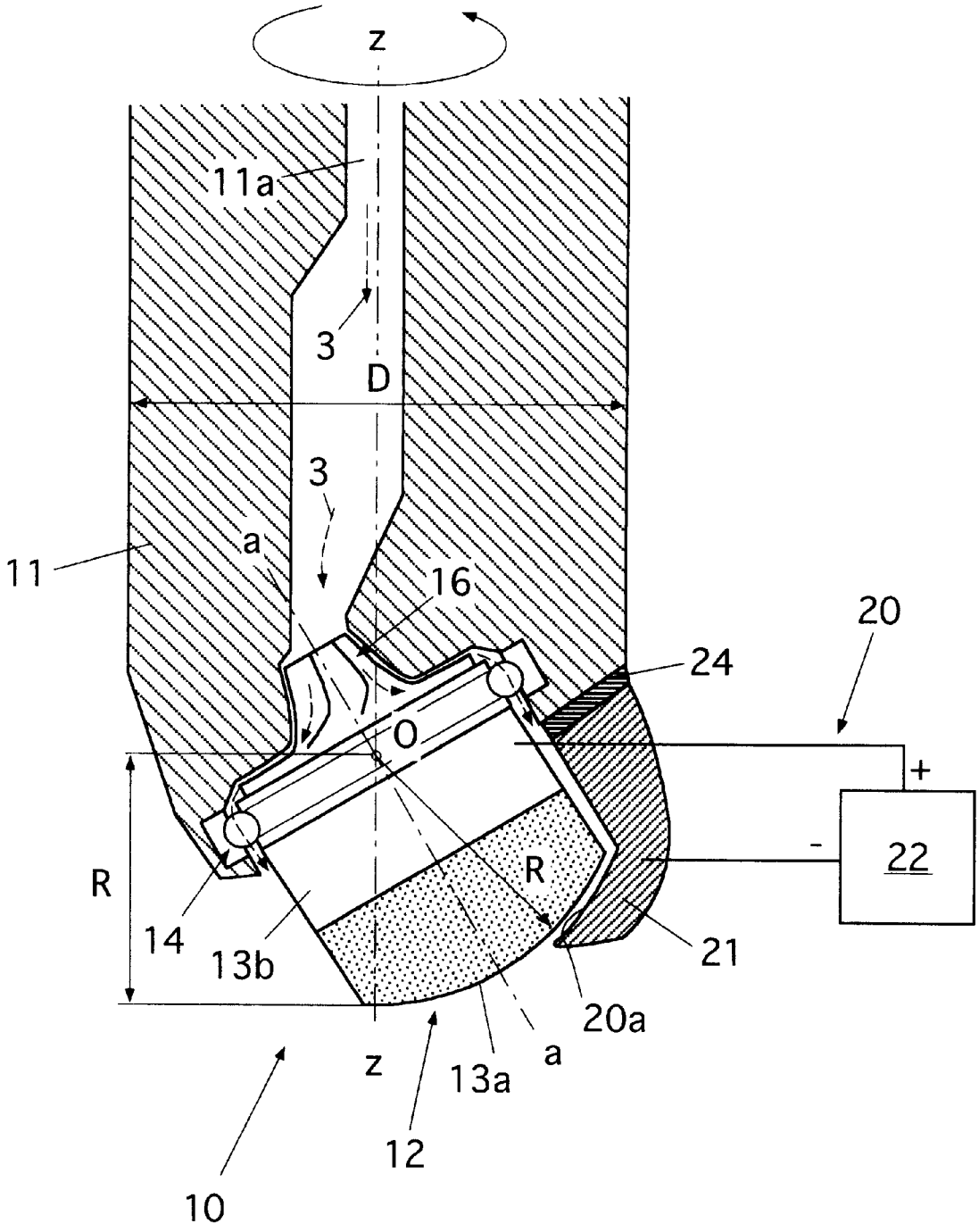
FIG. 2 shows a first embodiment of the free form machining tool according to the present invention.

Preferred embodiments of the present invention will be described below with reference to the accompanying drawings. It should be noted that corresponding portions have the same reference numerals throughout the drawings so as to omit the repeated description. FIG. 2 shows a first embodiment of a free form machining tool according to the present invention. A free form machining tool 10 of the present invention brings the lower end into contact with a surface 2 to be machined (see FIGS. 1A and 1B) by a rotation around an axis z so as to work the surface 2 to be machined. In the embodiments described below, the surface 2 to be machined is positioned below the free form machining tool 10 so as to work the surface 2 by the use of the lower end of the free form machining tool 10. However, the present invention is not limited to these embodiments. That is, the present invention can be also applied as it is when the surface 2 to be machined is positioned horizontally or above the free form machining tool 10 so as to work the surface 2 by the use of the horizontal end or upper end of the free form machining tool 10.

As shown in FIG. 2, the free form machining tool 10 of the present invention has a spherical tool 12 and a bearing 14. The spherical tool 12 has a spherical surface machining section 13*a* at least on the lower portion. The bearing 14 rotatably supports the spherical tool 12 by an axis a of rotation which passes through a center ○ of spherical surface of the spherical surface machining section 13*a* and is different from the axis z. In this drawing, reference numeral 11 denotes a tool body. The tool body 11 is mounted on a head of an NC machining apparatus (not shown) so that it may be rotatively driven around the axis z.

In this drawing, the spherical tool 12 further comprises a cylindrical straight section 13*b*, which is supported by the bearing 14 and has an axis that is the axis a of rotation of the bearing 14, and the spherical surface machining section 13*a* disposed on the lower portion of the straight section 13*b*. Preferably, a radius R from the center ○ of spherical surface of the spherical surface machining section 13*a* is set to about ½ of a diameter D of the tool body 11. More preferably, in case of the actual work of a mold cavity or the like, the radius R is set to $R \geqq L/2$ in order to prevent interference.

Preferably, the spherical surface machining section 13*a* is made of a grinder or a cutting blade. When the spherical surface machining section 13*a* is a grinder, preferably, the grinder includes a metal as its bonding material. By this construction, the spherical surface machining section 13*a* can be used for electrolytic dressing. High-accuracy/high-quality work can thus be efficiently accomplished.

The bearing 14 is a ball bearing in this embodiment. The roll of plural balls allows the spherical tool 12 to be rotated with high accuracy around the axis a of rotation. The present invention is not limited such a bearing. A roller bearing and a journal bearing can be used.

In FIG. 2, the free form machining tool 10 of the present invention further comprises rotating means 16 for rotating the spherical tool 12 around the axis a of rotation. In this embodiment, the rotating means 16 is a radial flow turbine mounted on the spherical tool 12. The radial flow turbine 16 is rotatively driven by a cutting fluid 3 supplied from a center hole 11*a* of the tool body 11. The cutting fluid 3 passes through the radial flow turbine 16, and then the cutting fluid 3 passes through a gap (between the balls) of the bearing 14. The cutting fluid 3 is supplied along a surface of the spherical surface machining section 13*a*.

The rotating means 16 of the present invention is not limited to the radial flow turbine. The rotating means 16 may be another type of turbine, motor, gear train, external power transmitting means or a combination of these.

The free form machining tool 10 of the present invention further comprises correcting means 20 for correcting the spherical surface machining section 13*a* of the spherical tool 12. The correcting means 20 comprises an electrode 21 and an applying apparatus 22. The electrode 21 has a spherical inner surface 21*a* which is spaced from and opposite to the spherical surface machining section 13*a*. A conductive fluid (the cutting fluid 3) is flowed between the inner surface 21*a* and the spherical surface machining section 13*a*. The applying apparatus 22 applies a voltage between the spherical surface machining section 13*a* and the electrode 21. The applying apparatus 22 shown in FIG. 2 is electrically connected to the spherical surface machining section 13*a* and the electrode 21 through the inside of the tool body 11 and insulated in an insulating section 24 so as not to interfere with the rotation of the free form machining tool 10.

In this construction, at the same time that the surface to be machined is ground by use of the conductive grinder 13*a*, the surface of the conductive grinder 13*a* can be corrected by the electrolytic dressing. The correcting means 20 of the present invention is not limited to such a construction. The correcting means 20 may be a grinder, an electrolysis, discharging means or composite means of these.

Figure 3:
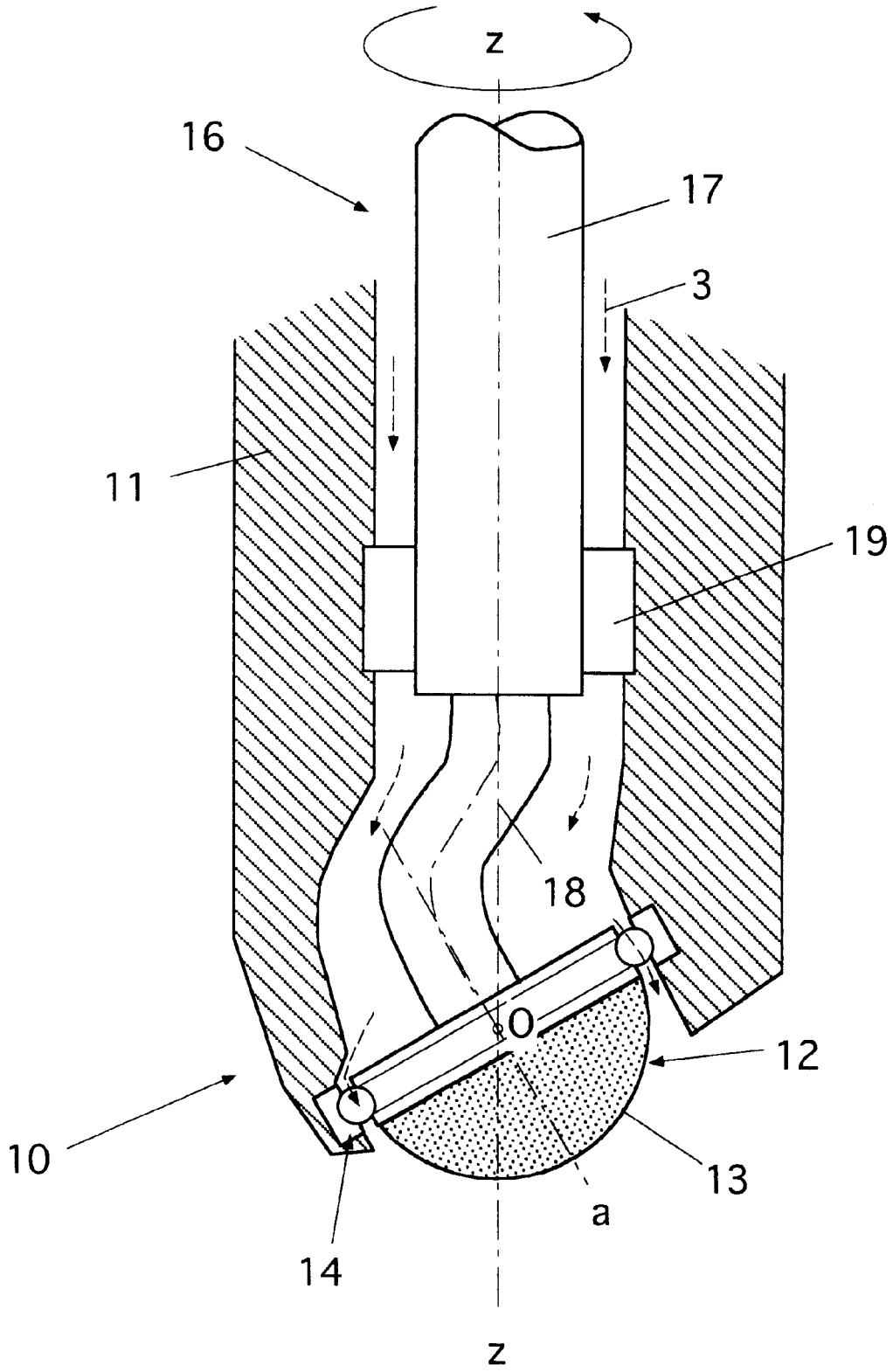
FIG. 3 shows a second embodiment of the free form machining tool according to the present invention.

FIG. 3 shows a second embodiment of the free form machining tool according to the present invention. In this drawing, the rotating means 16 comprises a center rotating shaft 17 rotating coaxially with respect to the tool body 11, a flexible joint 18 for coupling the lower end of the center rotating shaft 17 to the spherical tool 12 and a gear train 19 disposed between the tool body 11 and the center rotating shaft 17. The center rotating shaft 17 is supported by the bearing (not shown) so that it can be rotated around the axis z. The flexible joint 18 comprises, for example, a coil spring. Although the flexible joint 18 is freely flexed, it can transmit a rotary torque to the spherical tool 12. The gear train 19 is, for example, a harmonic drive. The gear train 19 makes an appropriate difference in speed between the tool body 11 and the center rotating shaft 17. In this construction, either the tool body 11 or the center rotating shaft 17 is rotatively driven, and thereby the tool body 11 is rotated around the axis z. At the same time, the spherical tool 12 can be rotated around the axis a of rotation. The other construction is the same as shown in FIG. 2.

Figure 4:
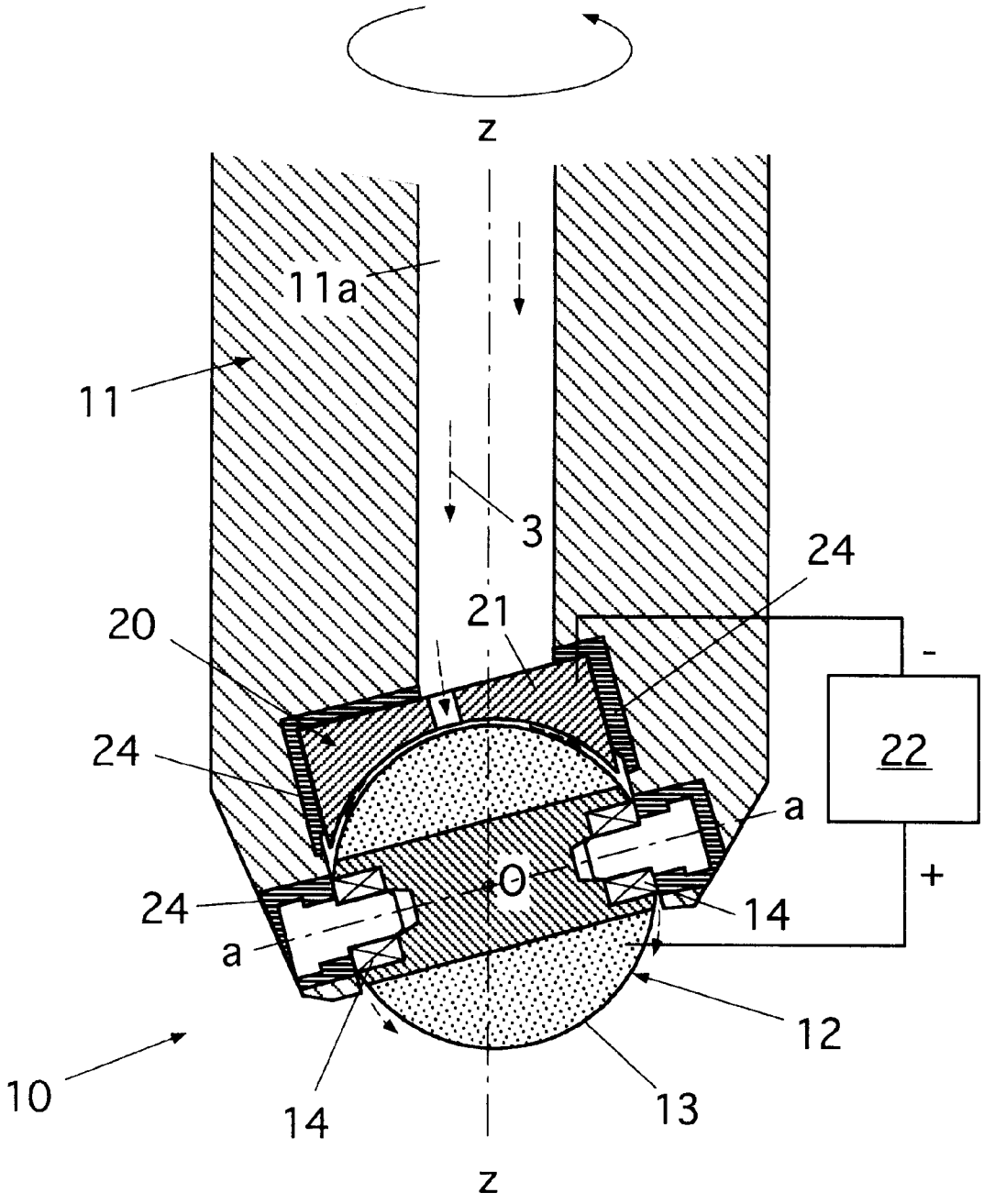
FIG. 4 shows a third embodiment of the free form machining tool according to the present invention.

FIG. 4 shows a third embodiment of the free form machining tool according to the present invention. In this drawing, the spherical tool 12 has a spherical surface machining section 13 whose whole is spherical. The spherical tool 12 is supported so that it can be rotated around the axis a of rotation which is slightly horizontally inclined (at about 15° in this drawing). In this embodiment, the spherical surface machining section 13 is the conductive grinder. Furthermore, the spherical tool 12 and the correcting means 20 are insulated from the tool body 11 by the insulating section 24. The other construction is the same as shown in FIGS. 2 or 3.

By this construction, at the same time that the surface to be machined is ground by the conductive grinder 13, the surface of the conductive grinder 13 can be corrected by the electrolytic dressing.

Figure 5:
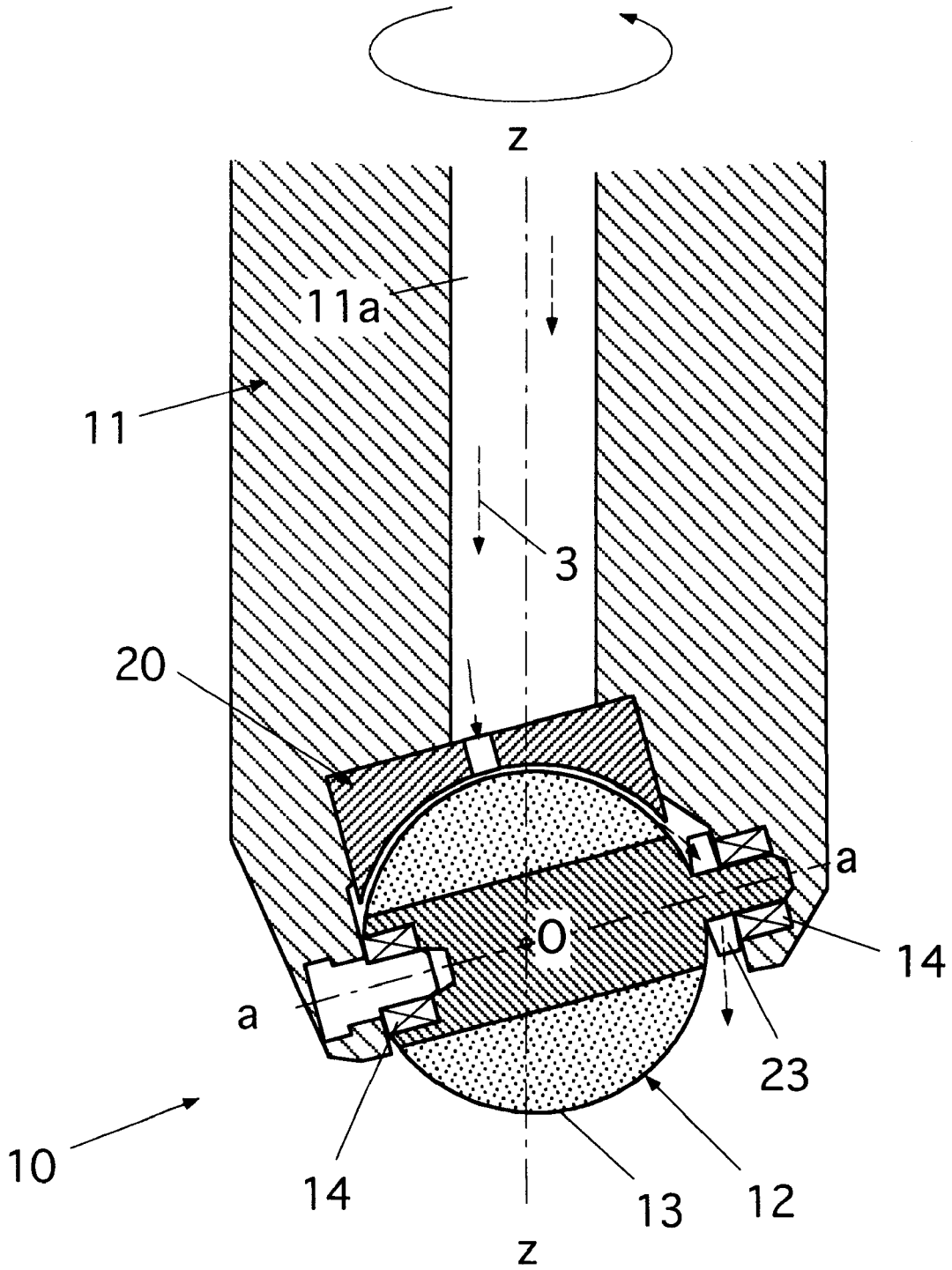
FIG. 5 shows a fourth embodiment of the free form machining tool according to the present invention.

FIG. 5 shows a fourth embodiment of the free form machining tool according to the present invention. In this drawing, the free form machining tool of the present invention has a turbine 23 for rotatively driving the rotating shaft of the spherical tool 12. The turbine 23 is rotatively driven by the cutting fluid 3 so that the spherical tool 12 may be rotated on its axis. The other construction is the same as shown in FIG. 4.

According to the above-described construction of the present invention, the free form machining tool 10 comprises the spherical tool 12 having the spherical surface machining section 13 on the lower portion and the bearing 14 for supporting the spherical tool 12 by the axis a of rotation which is different from the axis z. Thus, even if the spherical surface machining section 13 comes into contact with the surface to be machined on the axis (radius: 0) of the tool, the spherical surface machining section 13 is rotated around the axis a of rotation which is different from the axis z. Therefore, the peripheral speed of the axis is not zero (0). It is possible to efficiently work the freely curved surface with high accuracy and high quality by the use of the conventional triaxial NC machining apparatus.

As shown in FIGS. 2, 3 and 5, for example the free form machining tool 10 comprises rotating means for rotating the spherical tool 12 around the axis a of rotation. Thus, it is possible to positively rotate the spherical tool 12 around the axis a of rotation. It is possible to properly maintain a machining speed by the spherical surface machining section 13.

As exemplarily shown in FIGS. 4 and 5, the free form machining tool 10 further comprises correcting means 20 for correcting the spherical surface machining section 13 of the spherical tool 12. Preferably, at the same time that a material to be machined is machined, the spherical surface machining section can be corrected. It is possible to continue the high-accuracy/high-quality work for a long time.

The present invention is not limited to the above-mentioned embodiments. It is readily understood that various changes can be made within the scope and without departing from the spirit of the present invention. For example, in the aforementioned embodiments, there is a single axis a of rotation alone which passes through the center ○ of spherical surface of the spherical tool and is different from the axis. On the other hand, the present invention includes two or more axes of rotation which are differently directed.

As described above, the free form machining tool of the present invention achieves an excellent effect that the peripheral speed is not zero (0) on the axis and thus it is possible to efficiently work the freely curved surface with high accuracy and high quality by the use of a conventional triaxial NC machining apparatus.

Although the present invention is previously described based on some preferred embodiments, it is understood that the scope included in the present invention is not limited to these embodiments. On the contrary, the scope of the present invention covers all the improvements, modifications and equivalents included within the spirit and scope of the appended claims.

What is claimed is:

1. A free form machining tool having a z-axis, or machining a surface to be machined while bringing a lower end of the tool into contact with the surface to be machined, said tool comprising:

a spherical tool having a spherical surface, metal-bonded, grinder machining section at least on the lower portion; and a bearing for supporting said spherical tool in an axis of rotation which passes through a center of the spherical surface and is different from the z-axis.

2. The free form machining tool according to claim 1, wherein said spherical tool comprises:

a cylindrical straight section supported by said bearing and having an axis which is the axis of rotation of said bearing; and a spherical surface machining section disposed on a lower portion of said straight section.

3. The free form machining tool according to claim 1, comprising rotating means for rotating said spherical tool around the axis of rotation.

4. The free form machining tool according to claim 3, said rotating means of said spherical tool comprises any one of a turbine, a motor, a gear train and external power transmitting means or a combination of these.

5. The free form machining tool according to claim 1, further comprising correcting means for correcting said spherical machining surface of said spherical tool.

6. The free form machining tool according to claim 5, wherein said correcting means comprises one of a grinder, an electrolysis, discharging means or composite means of these.

7. The free form machining tool according to claim 5, wherein said correcting means is operated at the same time that a material to be machined is machined.

* * * * *